US010413147B2

(12) United States Patent
Hopkins et al.

(10) Patent No.: US 10,413,147 B2
(45) Date of Patent: Sep. 17, 2019

(54) SYSTEMS AND METHODS FOR PROVIDING A WAND FOR A FLOOR CLEANING APPARATUS

(71) Applicants: John M Hopkins, Pleasant Grove, UT (US); Gaylord M Karren, Pleasant Grove, UT (US); James K Stone, Pleasant Grove, UT (US); William R Shupe, Pleasant Grove, UT (US)

(72) Inventors: John M Hopkins, Pleasant Grove, UT (US); Gaylord M Karren, Pleasant Grove, UT (US); James K Stone, Pleasant Grove, UT (US); William R Shupe, Pleasant Grove, UT (US)

( * ) Notice: Subject to any disclaimer, the term of this patent is extended or adjusted under 35 U.S.C. 154(b) by 9 days.

(21) Appl. No.: 15/448,323

(22) Filed: Mar. 2, 2017

(65) Prior Publication Data

US 2017/0251896 A1 Sep. 7, 2017

Related U.S. Application Data

(60) Provisional application No. 62/302,716, filed on Mar. 2, 2016.

(51) Int. Cl.

| | |
|---|---|
| ***A47L 11/40*** | (2006.01) |
| ***A47L 11/34*** | (2006.01) |
| ***A47L 11/30*** | (2006.01) |

(52) U.S. Cl.

CPC ..... *A47L 11/4044* (2013.01); *A47L 11/30* (2013.01); *A47L 11/34* (2013.01); *A47L 11/408* (2013.01); *A47L 11/4088* (2013.01)

(58) Field of Classification Search

CPC ..... A47L 11/30; A47L 11/34; A47L 11/4044; A47L 11/408

See application file for complete search history.

(56) References Cited

U.S. PATENT DOCUMENTS 3,808,631 A * 5/1974 Shibata ..... A47L 11/34 134/175
3,828,390 A * 8/1974 Cater ..... A47L 11/34 15/321

(Continued)

FOREIGN PATENT DOCUMENTS

| | | | |
|---|---|---|---|
| CN | 204049531 | 12/2014 | |
| EP | 1508292 A2 * | 2/2005 | ..... A47L 9/02 |
| EP | 1508292 B1 | 2/2005 | |

*Primary Examiner* — Marc Carlson

(74) *Attorney, Agent, or Firm* — David B. Tingey; Bryant J. Keller; Kirton McConkie

(57) ABSTRACT

Systems and methods for providing a wand that is configured to clean a surface, such as carpeting and rugs, are disclosed herein. While the described wand can comprise any suitable component that allows it to be used to clean a surface, in some cases, the wand includes a wand head having a shroud, with a jet orifice and a vacuum port being disposed within the shroud. In some such cases, the vacuum port includes a breaker bar that is recessed within the shroud such that a portion of the shroud extends past the breaker bar. Additionally, in some cases, the shroud further includes one or more rollers that are optionally adjustable in height such that the wand head can is useable by operators of varying heights. In some cases, the wand head is coupled to a vacuum tube that attaches to a vacuum. Additional implementations are also described herein.

21 Claims, 14 Drawing Sheets

(56) References Cited

U.S. PATENT DOCUMENTS

| | | | | | |
|---|---|---|---|---|---|
| 4,392,270 | A * | 7/1983 | Magee | A47L 11/30 | 15/322 |
| 4,466,155 | A * | 8/1984 | Grave | A47L 11/30 | 15/321 |
| 5,113,547 | A * | 5/1992 | Mayhew | A47L 9/06 | 15/144.4 |
| 5,555,598 | A * | 9/1996 | Grave | A47L 11/34 | 15/322 |
| 5,891,198 | A * | 4/1999 | Pearlstein | A47L 11/34 | 15/322 |
| 9,468,351 | B2 * | 10/2016 | Meissner | A47L 11/34 | |
| 2002/0116784 | A1 * | 8/2002 | Sumner | A47L 11/03 | 15/322 |
| 2003/0024066 | A1 * | 2/2003 | Kennedy | A47L 9/244 | 15/322 |
| 2006/0248677 | A1 * | 11/2006 | Cho | A47L 11/34 | 15/321 |
| 2007/0028412 | A1 * | 2/2007 | Carter | A47L 11/34 | 15/321 |
| 2009/0100632 | A1 * | 4/2009 | Oh | A47L 5/362 | 15/320 |
| 2011/0155191 | A1 * | 6/2011 | Studebaker | A47L 11/34 | 134/56 R |

* cited by examiner

SYSTEMS AND METHODS FOR PROVIDING A WAND FOR A FLOOR CLEANING APPARATUS

RELATED APPLICATIONS

This application claims priority to U.S. Provisional Patent Application Ser. No. 62/302,716, filed Mar. 2, 2016, and entitled SYSTEMS AND METHODS FOR PROVIDING A WAND FOR A FLOOR CLEANING APPARATUS, which is incorporated herein in its entirety by reference.

BACKGROUND OF THE INVENTION

Field of the Invention

The present invention relates to systems and methods for cleaning flooring. In particular, the present invention relates to systems and methods for providing a wand that is configured to clean flooring, such as carpets, rugs, tile, stone, and other flooring surfaces.

Background and Related Art

Many conventional carpet cleaning devices comprise a cleaning attachment that is configured to deliver water and/or a cleaning agent to a surface, such as carpet. Additionally, many such carpet cleaning devices further include a vacuum that is coupled to the cleaning attachment such that water, detergent, and/or debris can be sucked up and removed from the surface through the attachment to improve the cleanliness of the surface.

While these cleaning attachments may be useful at cleaning flooring, such attachments are not necessarily without their shortcomings. Indeed, some such attachments are configured to soak the flooring and to leave a relatively large amount of water and/or cleaning agent on or in the flooring. Accordingly, in some cases, it may require a relatively large amount of time to dry the flooring that has been cleaned with a conventional device. Moreover, as some conventional devices may leave undesirable amounts of cleaning agents (which can attract dirt) on the surface being cleaned, such a surface may become (or may appear to become) dirty relatively soon after being cleaned. Additionally, some conventional cleaning attachments can be relatively difficult to use effectively.

Thus, while techniques currently exist that are used to clean flooring, challenges still exist, including those listed above. Accordingly, it would be an improvement in the art to augment or even replace current techniques with other techniques.

SUMMARY OF THE INVENTION

The present invention relates to systems and methods for cleaning flooring. In particular, the present invention relates to systems and methods for providing a wand that is configured to clean flooring, such as carpets, rugs, tile, stone, and other flooring surfaces.

While the described wand can comprise any suitable component or characteristic that allows it to be used to clean flooring (and/or any other suitable surface), in some implementations, the wand includes a wand head and a vacuum tube.

With respect to the wand head, the wand head can comprise any suitable component that allows it to apply a fluid to a flooring surface and that allows the fluid to be sucked from the surface. Indeed, in some implementations, the wand head comprises a shroud that houses one or more jets, jet streams, and/or vacuum ports. While the jets and vacuum ports can be disposed in any suitable location, in at least some cases, the jets are disposed behind the vacuum ports (e.g., closer to a user), such that the wand is configured to spray fluids and to suck up such fluids as the wand is pulled towards the user.

Additionally, in some cases, one or more of the vacuum ports include a breaker bar that is recessed within the shroud such that a portion of the shroud extends down past the breaker bar. Thus, in at least some implementations, the shroud is configured to form at least a partial seal with the flooring surface on which the shroud rests, and the shroud allows water and/or a cleaning agent that is sprayed from the jets to contact the flooring and to flow past the breaker bar and into the vacuum port.

In some implementations, breaker bar's position is optionally adjustable within the shroud such that the breaker bar can be adjusted for flooring of a variety of textures. In such implementations, the breaker bar can be adjusted in any suitable manner, including, without limitation, via one or more threaded fasteners that are configured to be selectively tightened and loosened to respectively lock and release the breaker bar to and from a desired location.

In some implementations, the wand head is optionally coupled to a roller that is configured to facilitate movement of the wand head across flooring. In such implementations, the roller is optionally adjustable such that the roller can be raised or lowered on the wand head to allow the wand to be adjusted for users of various heights while still allowing the shroud and/or wand head to make at least a partial seal with the flooring that is being cleaned.

With respect to the vacuum tube, the vacuum tube can comprise any suitable component or characteristic that allows a user to use the vacuum tube to direct the wand head and to allow liquids and/or debris sucked from the surface being cleaned to pass through the tube to a container, drain, and/or any other suitable depository.

In some implementations, the vacuum tube is shaped such that a user can easily slide the wand head across flooring (e.g., back and forth, side to side, and/or in any other suitable manner). In some implementations, however, the vacuum tube includes a first section that couples to the wand head, a second section that is configured to couple with a vacuum (e.g., via a hose or otherwise), and/or a third, elongated section that is disposed between the first section and the second section. While the various sections of the vacuum tube can have any suitable relation with respect to each other, in some implementations, a longitudinal axis of the first section runs at an angle between about 45 degrees and about 70 degrees with respect to a longitudinal axis of the third, elongated section, and the longitudinal axis of the third, elongated section runs at an angle between about 45 degrees and about 60 degrees with respect to a longitudinal axis of the second section.

In some implementations, in addition to and/or in place of the rollers, the wand head (e.g., the shroud) includes one or more lips that are configured to make it easier for a user to move the wand head across a flooring surface. While such a lip can be disposed in any suitable location, in some implementations, the lip is disposed at a back side of the shroud (e.g., a side of the shroud facing a user operating the wand) so as to allow a front side of the shroud to be pushed close to objects (e.g., a wall, furniture, and/or other objects) that are adjacent to and/or placed on the flooring.

In some implementations, the described wand further includes one or more filters. While such filters can be disposed in any suitable location, in some implementations, a filter is disposed on the wand adjacent to the wand head.

In some other implementations, however, a filter is disposed on the vacuum tube closer to a trigger assembly than to the head. Accordingly, in some embodiments, the wand head is able to remain relatively light (e.g., to help the head to easily slide across flooring surfaces).

While the devices, systems, and methods of the present invention may be particularly useful in the area of cleaning flooring, such as carpets, rugs, tile, stone, cement, brick, linoleum, wood, laminate, vinyl, rubber, mosaic, terracotta, glass, cork, and/or any other suitable type of flooring, those skilled in the art will appreciate that the described devices, systems, and methods can be used to clean any other suitable surface, including, without limitation, upholstery, furniture, draperies, blinds, walls, clothing, and/or any other suitable surface.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of embodiments of the invention may be learned by the practice of such embodiments or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only representative embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

Figures 1A, 1B, 1C:
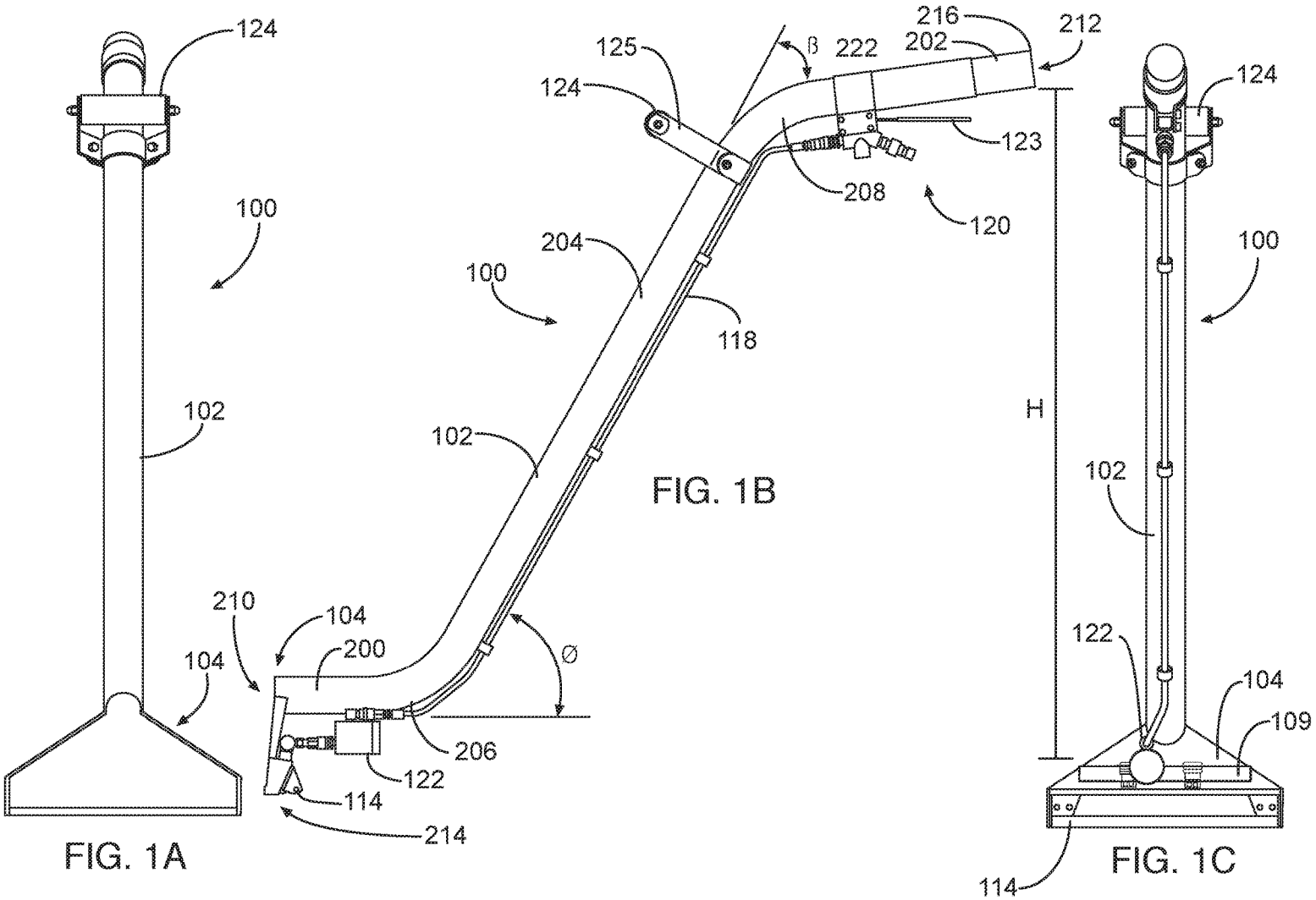
FIGS. 1A, 1B, and 1C respectively illustrate a front, side, and rear elevation view of a representative embodiment of a wand.

The present invention relates to systems and methods for cleaning flooring. In particular, the present invention relates to systems and methods for providing a wand that is configured to clean flooring, such as carpets, tile, stone, and other flooring surfaces.

In the disclosure and in the claims the terms flooring, floor, flooring surface, and variations thereof, may refer to any suitable form of carpet, rug, tile, stone, wood, slate, cement, laminate, vinyl, vinyl asbestos, mosaic, terracotta, terrazzo, ceramic, unglazed ceramic, brick, paver, porcelain, glass, cork, linoleum, rubber, grout, composite, synthetic, natural, cultured, and/or other floor surface that can be cleaned and/or otherwise treated by the described wand. In some cases, the terms flooring, floor, flooring surface, and variations thereof, may refer to upholstery, furniture, draperies, blinds, walls, clothing, and/or any other suitable surface and/or material that can be cleaned (at least partially) with the described wand.

In general, the described systems and methods relate to a wand that is configured to spray one or more fluids (e.g., water, electrolyzed alkaline water, electrolyzed acidic water, stabilized alkaline water, stabilized acidic water, reverse osmosis water, deionized water, cleaning agents, detergents, soaps, air, waxes, stain guards, dyes, pre-treatments, post-treatments, and/or any other suitable fluid) onto flooring and to then have such fluid and/or debris be sucked from such flooring, through the wand, and into a depository (e.g., a tank, container, a drain, and/or any other suitable location).

While the described wand can comprise any suitable component or characteristic that allows it function as intended, FIGS. 1A-1G illustrate some embodiments in which the wand 100 comprises one or more vacuum tubes 102, wand heads 104, shrouds 106, jets 108, jet manifolds 109, vacuum ports 110, breaker bars 112, rollers 114, lips 116, feed lines 118, trigger assemblies 120, filters 122, handles 124, and/or handle supports 125.

With respect to the vacuum tube 102, the tube can comprise any suitable characteristic that allows it to be used to push, pull, and/or otherwise direct movement of the wand head 104 and to conduct fluids, debris, and/or other material from the wand head to a depository. In some embodiments, the vacuum tube has a relatively large inner diameter, which allows an increased amount of air, oxygen, water, fluid, debris, and/or other materials to pass through the tube. Indeed, in some embodiments, because of its relatively large inner diameter, the tube is able to allow a standard vacuum to pass more air across (and pull more fluid from) the flooring being cleaned than could the same vacuum with a smaller vacuum tube. As a result, some embodiments of the described vacuum tube allow the flooring to dry faster than would smaller vacuum tubes. Moreover, because of its relatively large inner diameter, some embodiments of the described vacuum tube are able to perform a better job at removing dirt, hair, flooring fragments, oil, sand, stains, and/or other debris from flooring that is cleaned with the described vacuum tube.

While the vacuum tube 102 can have any suitable inner diameter (e.g., between about 5 mm and about 25 cm, or within any subrange thereof), in some embodiments, the described tube comprises an inner diameter between about 3.8 cm and about 7.7 cm, or any subrange thereof. Indeed, in some embodiments, the tube's inner diameter is between about 3.45 cm and about 6.35 cm, or any subrange thereof (e.g., about 4.45 cm±0.5 cm).

The wall of the vacuum tube 102 can be any suitable thickness that allows it to function as described herein. Indeed, in some embodiments, the vacuum tube wall is between about 0.25 mm and about 5 mm (or within any subrange thereof). Indeed, in some embodiments, the vacuum tube wall is between about 0.5 mm and about 1.3 mm thick (e.g., about 0.89 mm±0.3 mm).

When the wand head 104 is disposed on a flooring surface such that the wand head and/or the shroud 106 form a seal (or at least a partial seal) on the flooring surface, the distance between the front end 210 of the wand head 104 and the back end 212 of the vacuum tube 102 (shown as L in FIG. 1B) can be any suitable distance. In some embodiments, such distance (L) is between about 50 cm and about 152 cm (or within any subrange thereof). Indeed, in some embodiments, the distance L is between about 91 cm and about 115 cm (e.g., between about 96 cm and about 107 cm).

When the wand head 104 is disposed on a flooring surface such that the wand head and/or the shroud 106 form a seal (or at least a partial seal) on the flooring surface, the distance between the bottom end 214 of the wand head 104 and the top end 216 of the vacuum tube 102 (shown as H in FIG. 1B) can be any suitable distance. In some embodiments, such distance (H) is between about 60 cm and about 120 cm (or in any subrange thereof). Indeed, in some embodiments, the distance L is between about 76 cm and about 105 cm (e.g., between about 83 cm and about 94 cm).

Figure 1D:
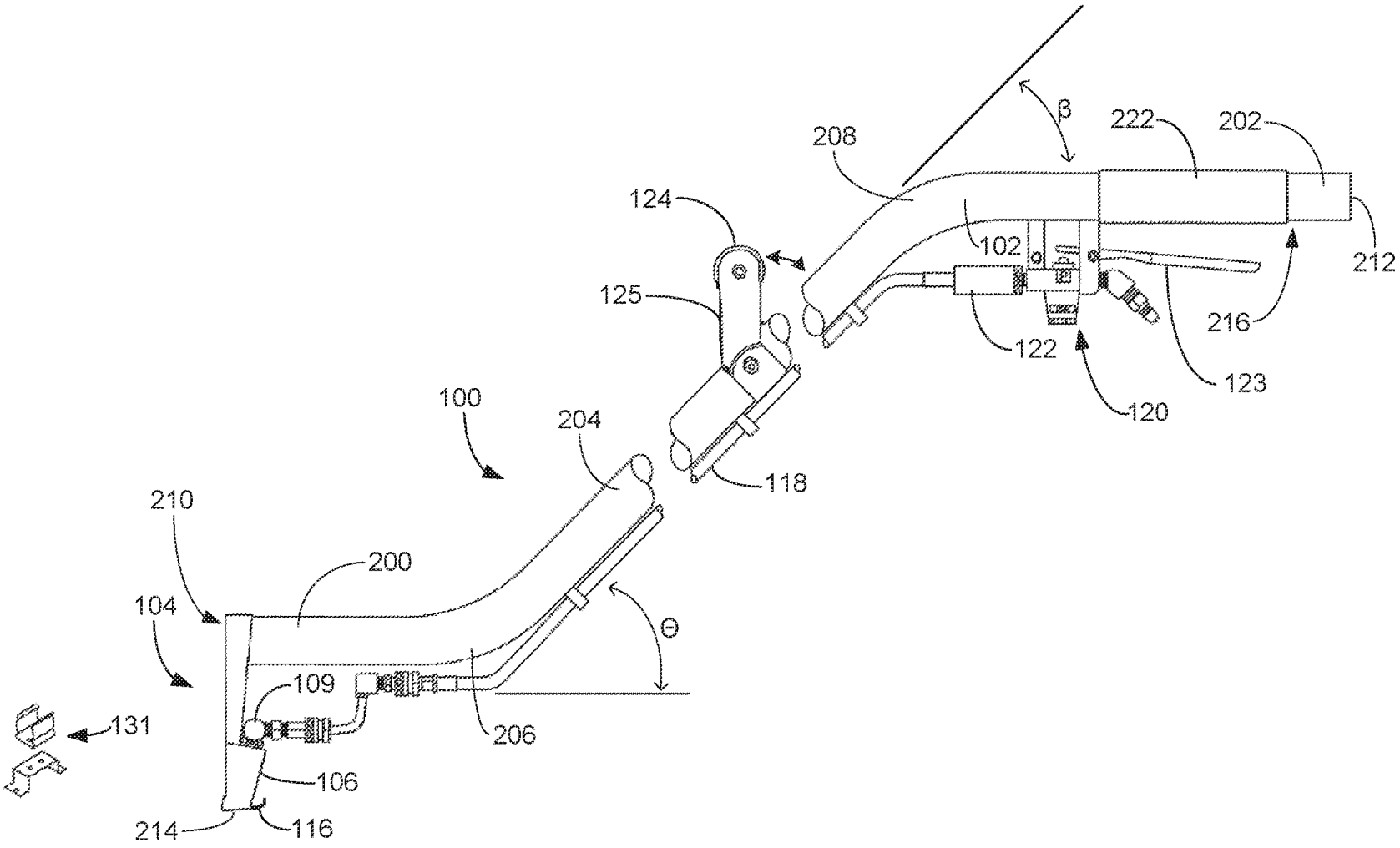
FIG. 1D illustrates a side schematic view of a representative embodiment of the wand.

The vacuum tube 102 can be any suitable shape, and can comprise any suitable number of tubing sections (e.g., a single monolithic tube section or 2, 3, 4, 5, 6, or more sections that couple together) that allows the vacuum tube to perform its described functions. In some embodiments, however, the tube comprises two or more sections (e.g., comprising discrete components and/or a single component having multiple sections) that are at least partially disposed at an angle to each other. Indeed, in accordance with some embodiments, FIGS. 1B and 1D show that the vacuum tube 102 comprises a first section 200, a second section 202, and/or a third section 204, with a first bend 206 (or elbow) disposed between the first 200 and third 204 sections and a second bend 208 (or elbow) disposed between the second 202 and the third 204 sections.

Where the vacuum tube 102 comprises a bend (e.g., a first bend 206, a second bend 208, and/or any other suitable bend) between one or more sections, the various sections of the vacuum tube can have any suitable special relation to each other. Indeed, in some embodiments, the bend 206 between the first 200 and the third 204 section causes a length of the third section 204 (e.g., a longitudinal axis of a portion of the third section) to run with respect to a length of the first section 200 (e.g., a longitudinal axis of a portion of the first section) at an angle θ that is between about 35 degrees and about 70 degrees (or that falls in any subrange thereof). Thus, in some embodiments, a length of the third section runs at an angle to the first section of between about 52 degrees and about 65 degrees (e.g., about 56 degrees±2 degrees).

In some embodiments, the second bend 208 between the second section 200 and the third 204 section causes a length of the third section 204 (e.g., the longitudinal axis of a portion of the third section) to run with respect to a length of the second section 204 (e.g., the longitudinal axis of a portion of the second section) at an angle β that is between about 35 degrees and about 70 degrees (or that falls in any subrange thereof). Thus, in some embodiments, a length of the third section runs at an angle to the second section of between about 48 degrees and about 56 degrees (e.g., about 50 degrees±2 degrees).

In any case, in some embodiments, by placing the wand head 104 at a suitable distance and/or angle from the user (as described above), the user can move the wand head relatively more easily than could be done if the wand head were too close to, or at too steep of an angle to, the user (e.g., thus causing the wand head to dig into and/or to skip across the flooring). Indeed, in accordance with some embodiments, the length of the vacuum tube 102 in combination with the various angles in the tube (as discussed above) have provided surprising and unexpected results. Indeed, while some conventional devices that are shorter and/or that have inappropriate angles cause a user to push the wand into the flooring and can thereby result in rapid user fatigue, some embodiments of the described wand (with its described angles and length) place the wand head in an optimal working position that allows users of different heights to easily push and/or glide the wand head across a flooring surface being cleaned with significantly less user fatigue that is caused by some competing devices.

In some embodiments, the length of one of more sections (e.g., the first 200, second 202, and/or third 204 sections) and/or other portions of the vacuum tube 102 are optionally adjustable to allow the tube to be resized and/or otherwise tailored for individual users and/or uses. Accordingly, in some such embodiments, the distances L and/or H are selectively adjustable. In such embodiments, the length of the vacuum tube and/or any portion or section thereof can be selectively adjustable in any suitable manner, including, without limitation, via a telescoping mechanism that comprises a tube within a tube and that allows one tube to slide with, and to be selectively locked and released (e.g., via a twist-lock telescoping mechanism, a detent mechanism, a mechanical engagement, a frictional engagement, one or more fasteners, and/or in any other suitable manner), with a respect to another tube of the vacuum tube.

In some embodiments, the vacuum tube 102 is optionally configured such that the angle between one or more sections (e.g., sections 200, 202, 204, etc.) are adjustable to allow the tube to be tailored for users of different size and/or different uses. In such embodiments, the various angles of the vacuum tube can be adjusted in any suitable manner. Indeed, in one example, an angle between two sections in the tube is adjusted by switching a bend (e.g., 206 and/or 208) in the tube with another bent section (e.g., an elbow joint or other suitable component) and/or another section having a different desired angle. In this example, the various bent and/or other sections can be coupled to the vacuum tube in any suitable manner, including, without limitation, via one or more detent mechanisms, friction fittings, mechanical connection mechanisms, fasteners, adhesives, welds, and/or any other suitable mechanisms.

In another example of a method for modifying the shape of the vacuum tube 102, some embodiments of the vacuum tube comprise one or more flexible components (e.g., a flexible tube with an adjustable rigid scaffolding that is configured to selectively lock in and be released from a desired orientation, a flexible exhaust-pipe-like tube, and/or any other suitable component that allows an angle between two or more portions of the vacuum tube to be selectively adjustable and selectively maintained.

Figure 1E:
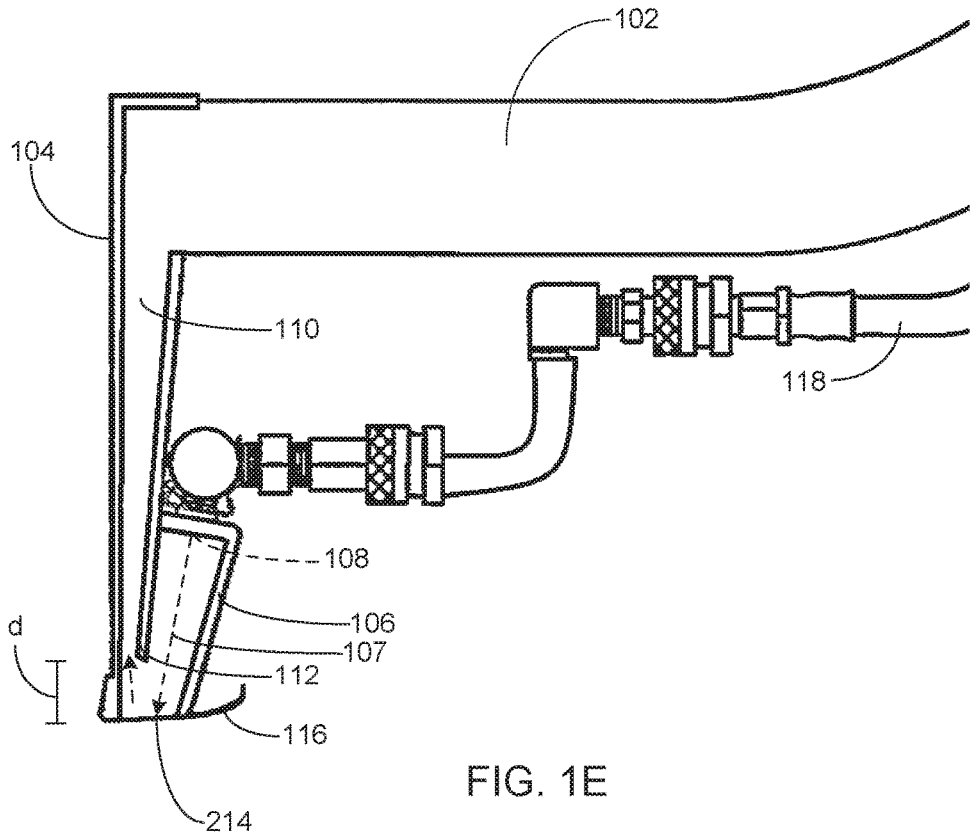
FIG. 1E illustrates a partial, side, cross-sectional view of a representative embodiment of the wand head.
Figure 1F:
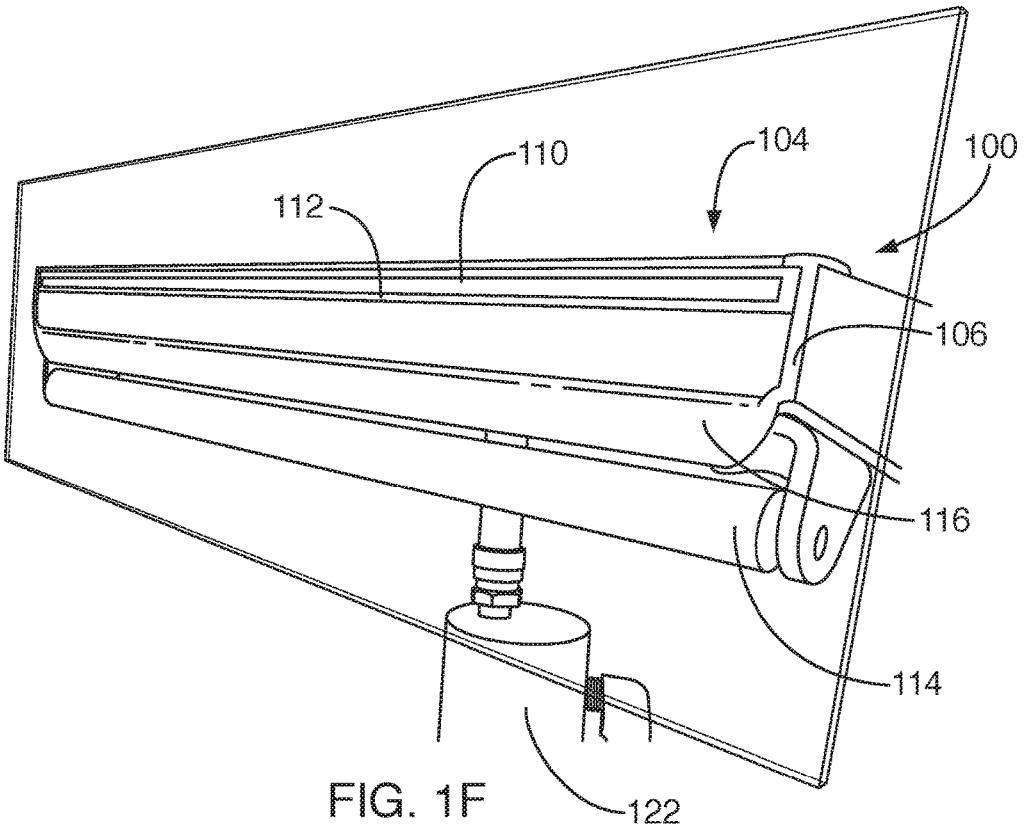
FIG. 1F illustrates a perspective view of the wand head in which the head is in contact with a piece of a transparent material such that a shroud of the wand head and/or the wand head forms at least a partial seal with the transparent material and such that fluid sprayed from one or more jets in the head is allowed to be sucked up into a vacuum port in the wand head in accordance with some embodiments.
Figure 1G:
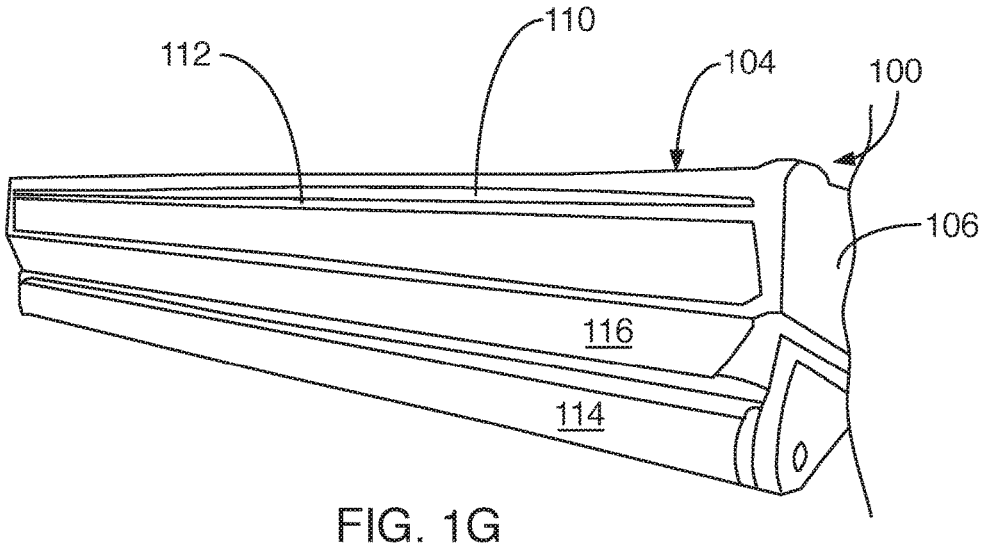
FIG. 1G illustrates a perspective view of a portion of the wand head in accordance with a representative embodiment.

With reference now to the wand head 104, the wand head can comprise any suitable feature that allows it to apply a fluid (e.g., via one or more nozzles, orifices, sprayers, and/or other jets 108) to flooring being cleaned and to allow such fluid and/or debris to be drawn from the flooring (e.g., via one or more vacuum ports 110 that are configured to funnel and/or otherwise direct fluid, debris, air, and/or other materials to the vacuum tube 102). In this regard, some embodiments of the wand head comprise 1, 2, 3, 4, 5, 6, 7, 8, 9, 10, or more jets and/or vacuum ports. Indeed, in some embodiments, the head comprises 3-6 jets (e.g., coupled to a jet manifold 109 or otherwise connected to one or more feed lines 118) and one vacuum port.

Where the wand head 104 comprises one or more jets 108 and vacuum ports 110, the jets and vacuum ports can be disposed in and/or on the head with any suitable relation to each other. Indeed, although some embodiments of the head comprise jets in front of the vacuum port (e.g., distal to the vacuum port or the operator), in some other embodiments, the jets 108 (and/or jet manifold 109) are disposed (as shown in FIG. 1E) behind the vacuum port (e.g., proximal to the port or the operator). In some of these latter embodiments, the wand is configured to be a pull wand—allowing fluid that is sprayed from the jets to be rapidly sucked up when the wand is being pulled (e.g., backwards).

In some embodiments, the jets 108 and/or the vacuum port 110 are at least partially disposed in and/or in fluid communication with a shroud 106. In other words, some embodiments of the head 104 comprise a sealed loop (or at least partially sealed loop) system in which fluid sprayed from the jets within the shroud is allowed to contact the flooring being cleaned and to then be sucked up into the vacuum port in a relatively short period of time. By way of non-limiting illustration, FIG. 1E shows an embodiment in which the shroud 106 is configured to extend around a portion of the head 104 so as to extend around a spray, mist, curtain, and/or other effluent 107 of the jets 108 and to form a seal (or at least a partial seal) with a flooring surface (not shown) upon which the head rests.

In some embodiments, to help fluid flow from the jets 108, across the flooring, and into the vacuum port 110, the wand head 104 comprises a recess, surface, and/or other form of breaker bar 112 that is recessed within the shroud 106 (e.g., between a space of the shroud and the vacuum port) such that one or more surfaces of the shroud extend past (e.g., below) the breaker bar. In some such embodiments, by having the breaker bar be recessed within the shroud, the shroud (and/or head) is able to contact and form at least a partial seal with the flooring surface while the breaker bar is held slightly higher up above the flooring to allow fluid to rapidly pass from the flooring into the vacuum port. Thus, in some embodiments, the recessed breaker bar allows fluid leaving the jets and contacting the flooring to rapidly change direction (e.g., doing a U-turn) and to pass into the vacuum port. As a result of this sealed (or semi-sealed) loop system, some embodiments of the wand are configured to force the fluid across the flooring (e.g., through carpet) and then to suck such fluid up into the vacuum port without allowing the fluid to flood the flooring and/or to settle into flooring (e.g., the carpet backing and/or padding). Thus, some embodiments of the described systems are capable of cleaning flooring with high-pressure fluid and then allowing such flooring to dry significantly faster than do some other conventional methods and devices.

Where the wand head 104 comprises a recessed breaker bar 112, the breaker bar (or a portion thereof) can terminate and/or be disposed at any suitable distance from (e.g., above) the bottom end 214 of the wand head 104 and/or the shroud 106 that allows the wand head to function as described herein. Indeed, in some embodiments, the breaker bar is disposed a distance (as shown by d in FIG. 1E) between about 2 mm and about 3 cm (or any subrange thereof) above the head's bottom end. Indeed, in some embodiments, the breaker bar is disposed between about 0.5 cm and about 1.5 cm above the head's bottom end.

In some embodiments, to allow the wand head 104 to be adjusted and/or optimized for various types of flooring (e.g., tile, shag carpet, etc.) with various characteristics, the breaker bar 112 is adjustably attached to the wand head such that the breaker bar (or a portion thereof) can be selectively raised and lowered in the head (and/or such that a portion of the shroud and/or head can be raised and lowered with respect to the bar). In such embodiments, the breaker bar (and/or shroud and head) can be adjustable in any suitable manner, including, without limitation, by being coupled to one or more threaded fasteners, detent mechanisms, grooves into which portions of the head (or an attached object) slidably fit, one or more lever mechanisms that cause the bar (and/or the shroud and/or head) to move when a lever is moved, and/or any other suitable mechanism that allows at least a portion of the breaker bar (and/or the shroud/head) to be raised and/or lowered in and/or in the head. Indeed, in some embodiments, the breaker bar is slidably coupled within the head via one or more threaded fasteners that can be loosened to move, and tightened to secure, the bar.

With reference now to the roller 114, some embodiments of the wand 100 optionally comprise 1, 2, 3, 4, 5, 6, 7, 8, 9, 10, or more wheels, bearings, casters, and/or other rollers that are configured to help the wand head 104 be moved across a flooring surface with relatively little effort. While the rollers can be disposed in any suitable location on the wand (e.g., in front, behind, and/or to the side of the vacuum port 110), in some embodiments, the roller is disposed behind the vacuum port, the jets 108, and the shroud 106 (e.g., as shown in FIGS. 1B. 1F, 1G, 2A, 3A, 4, 5, and 9). In some such embodiments, by placing the roller behind the port (e.g., proximal to the operator), the wand can be used to clean right up next to walls and other objects.

Figure 5:
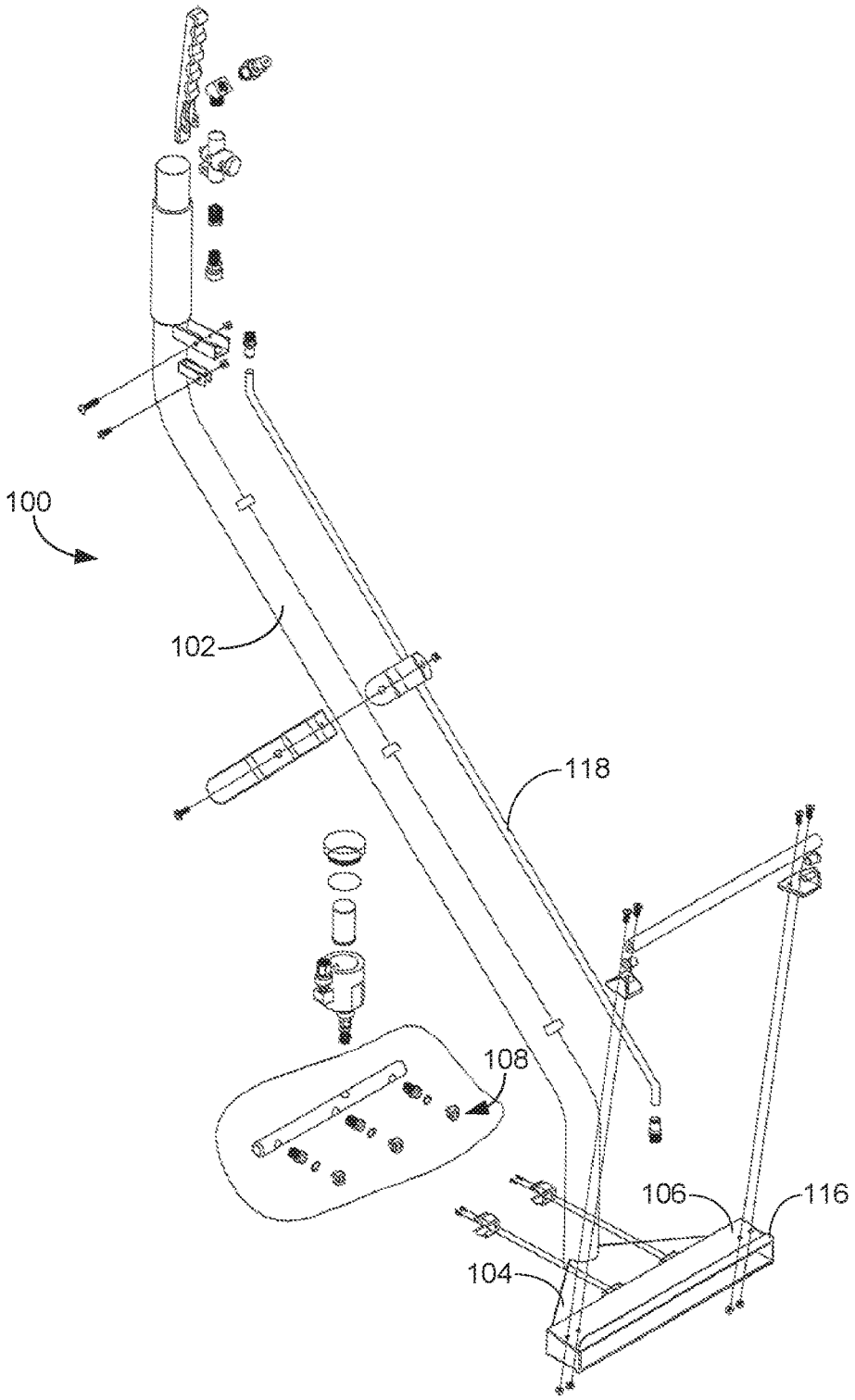
FIG. 5 illustrates a perspective, exploded view of a representative embodiment of the wand.
Figure 9:
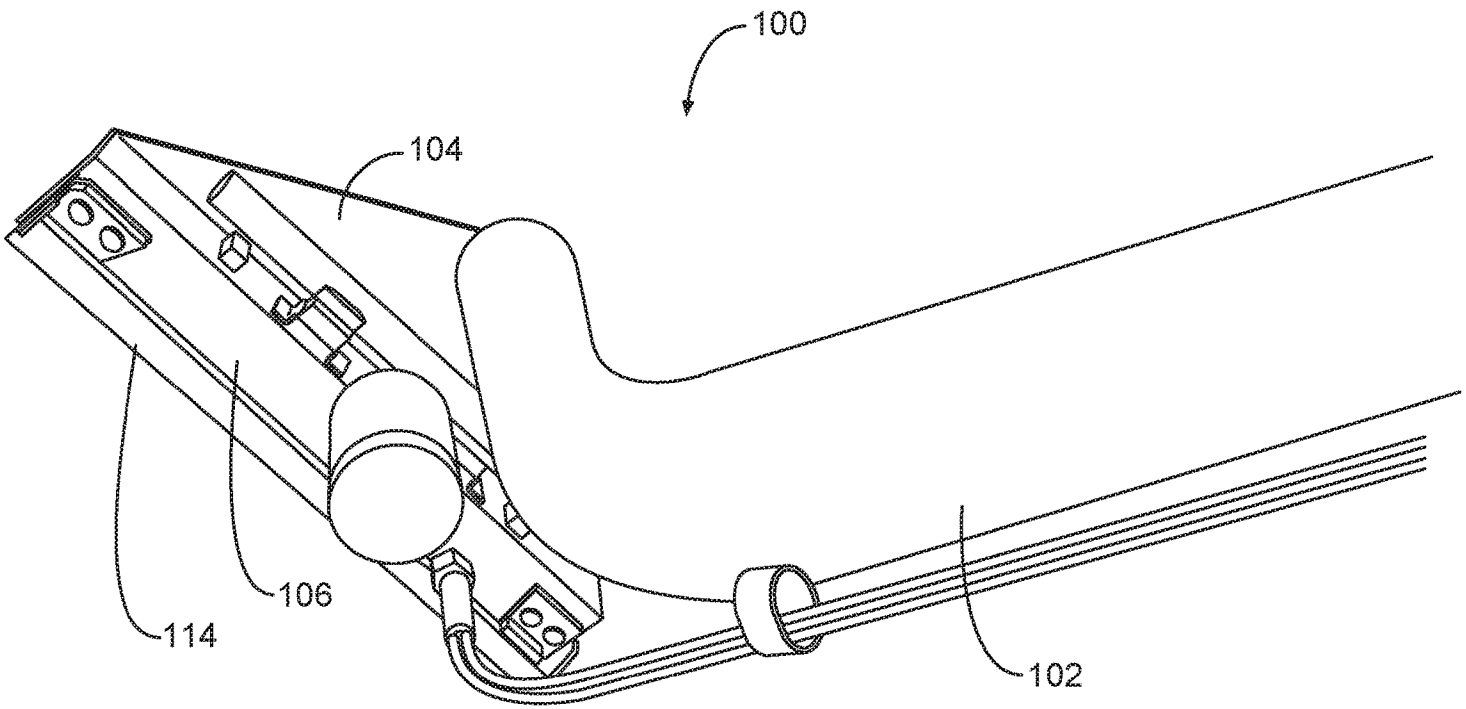

In some embodiments, the roller 114 is optionally adjustable such that it can be moved up or down on the wand head 104. In this manner, the wand 100 can be adjusted to allow operators of various heights to use the wand in a position that is comfortable to the individual operators while allowing such operators to maintain at least a partial seal between the shroud 106 and/or the head and the flooring being cleaned. Indeed, in some embodiments in which the roller's height is fixed, a relatively tall operator may hold the wand at such an angle that the roller does not contact the flooring throughout the operator's full stroke of the wand—thus making it hard for the operator to force the wand head across the flooring. In contrast, in some embodiments in which the roller's height is fixed (e.g., at the same height as it was for the relatively tall operator), an operator that is relatively short may hold the wand at such an angle that the roller contacts the flooring and acts as a fulcrum that lifts the front of the head off the flooring and prevents the shroud from forming a desirable seal with the flooring. Thus, in some embodiments, the adjustable roller can allow an operator to tailor the wand to the operator's size and needs, while allowing the wand to clean flooring surfaces.

Where the roller 114 is selectively adjustable, the roller can be adjusted in any suitable manner, including, without limitation, via one or more detent mechanisms, ratchet mechanisms, level mechanisms, the loosening and tightening of one or more screws, by being able to attach the roller to the head at more than one position (e.g., in a variety of connection points), and/or in any other suitable manner. Indeed, in some embodiments, the roller is coupled to one or more brackets that can be coupled to the rear of the head in multiple positions (e.g., via the tightening and/or loosening of one or more screws, as shown in FIGS. 5 and 9).

In place of, or in addition to, the roller 114, some embodiments of the wand head 104 comprise one or more angled surfaces, rounded surfaces, and/or any other suitable lips 116 that extend from the head and/or the shroud 106 that help the head to easily slide across flooring surfaces (e.g., without skipping across the flooring surface and/or requiring undue amounts of force to move the head). While such lips can extend from any suitable portion of the wand head and/or the shroud, including, without limitation, from a front side, back side, right side, left side, corner, and/or any other suitable portion of the wand head and/or the shroud, FIGS. 1D-1G show some embodiments in which the lip 116 extends from a back side of the shroud 106.

With respect now the trigger assembly 120, the trigger assembly can comprise any suitable mechanism that allows a user to selectively start, stop, increase, decrease, and/or otherwise control the flow of fluid through the feed line 118 and jets 108. Indeed, FIGS. 1B, 1D, 3A, and 4 show some embodiments in which the trigger mechanism 120 comprises a manually controlled valve that is opened when the trigger lever 123 is squeezed and closed when the trigger lever is released. In some other embodiments that are not shown, the trigger mechanism comprises one or more catches, detents, and/or other mechanisms that are configured to selectively catch and/or otherwise retain the trigger lever in a desired position so as to provide a desired flow of fluid through the feed line. Indeed, in some embodiments, the trigger mechanism functions much like a gas pump trigger that is configured to have a lever (e.g., the trigger lever 123 and/or another lever) be selectively captured in one or more catches and then to be released from such catches when the trigger lever is squeezed (and/or as otherwise determined, for instance, when the system determines that a sufficient or exorbitant amount of fluid has been disposed in the flooring, as discussed below).

In still other embodiments, the trigger mechanism 120 comprises one or more electronically controlled valves, pneumatically actuated values, solenoids, and/or other valve mechanisms that are that are configured to allow a user to easy control fluid flow through the feed line 118. Thus, in some such embodiments, the described systems and methods reduce user fatigue (e.g., fatigue associated with gripping the trigger lever 123 for long periods of time).

With reference now to the filter 122, some embodiments of the described wand 100 comprise one or more filters that are configured to perform any suitable purpose, including, without limitation, preventing debris in the feed line 118 from clogging a jet 108. In such embodiments, the wand can comprise any suitable number of filters (e.g., 1, 2, 3, 4, 5, 6, or more) that are disposed in any suitable location. Indeed, in accordance with some embodiments, FIG. 1B shows the wand 100 comprises a single filter 122 that is disposed adjacent to the wand head 104 (e.g., coupled to the first section 200). In accordance with some other embodiments, however, FIG. 1D shows an embodiment in which the filter 122 is disposed at or between the first bend 206 and the end 212 of the vacuum tube 102. Indeed, while the filter can be disposed in any suitable location (e.g., between a midpoint of a length of the third section 204 and the tube's end 212), FIG. 1D shows an embodiment in which the filter 122 is coupled to the second section 202 (e.g., at and/or near the second bend 208). In this regard, while there may be several reasons to place the filter adjacent to the wand head, in some cases, placing the filter near the second section 202 can make the wand head lighter and easier to move and may result in less fatigue to the user (especially, where the second and/or third sections of vacuum tube are strapped (e.g., via a shoulder strap, a belt loop strap, etc.) and/or otherwise connected to the user to reduce user fatigue).

Figure 1H:
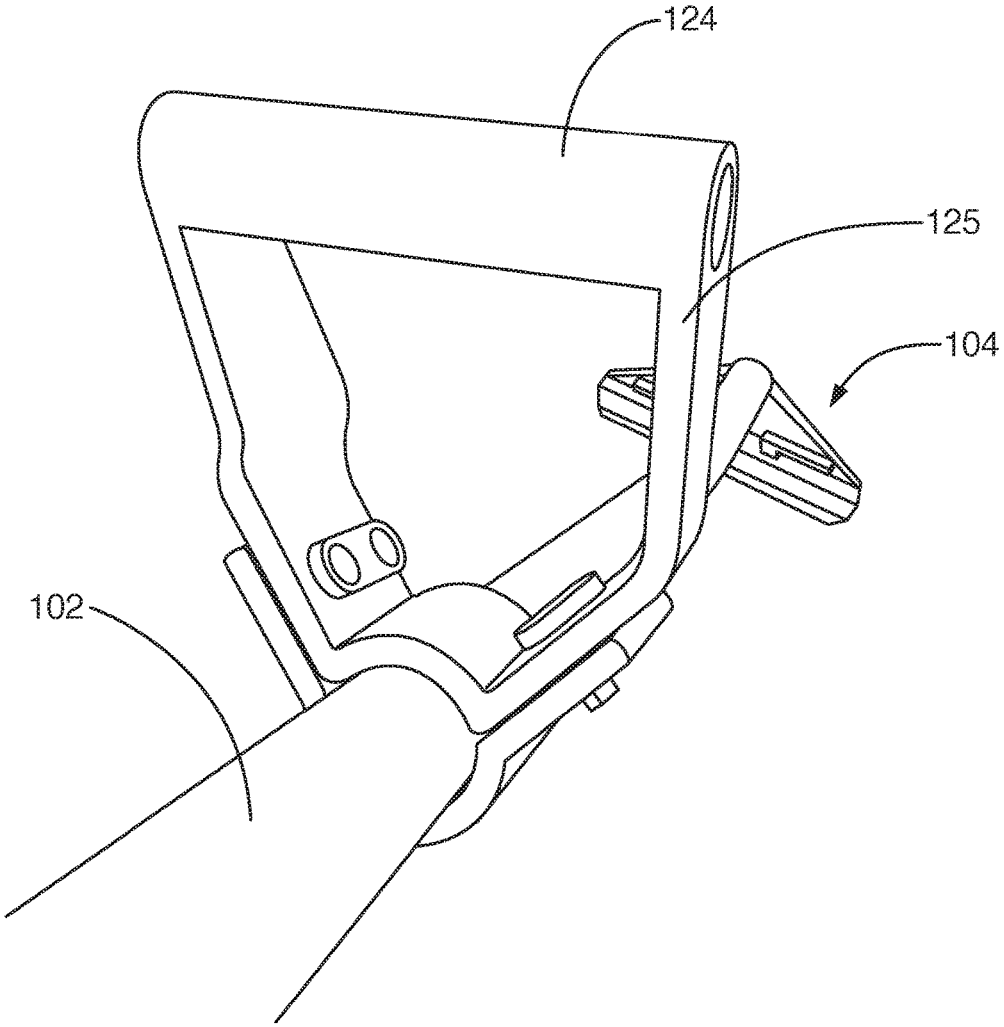
FIGS. 1H-1I illustrate perspective views of a wand handle in accordance with some embodiments.
Figure 1I:
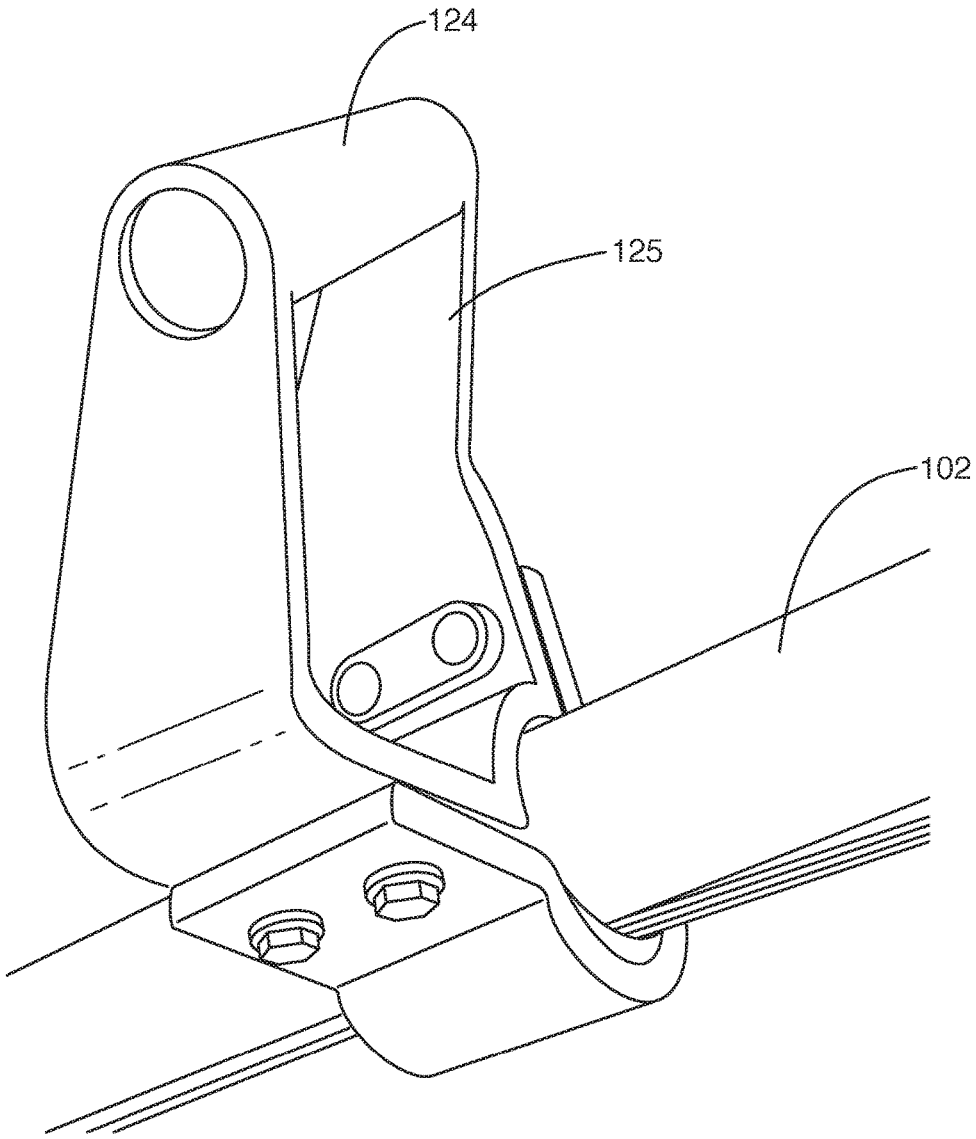
Figures 2A, 2B, 2C:
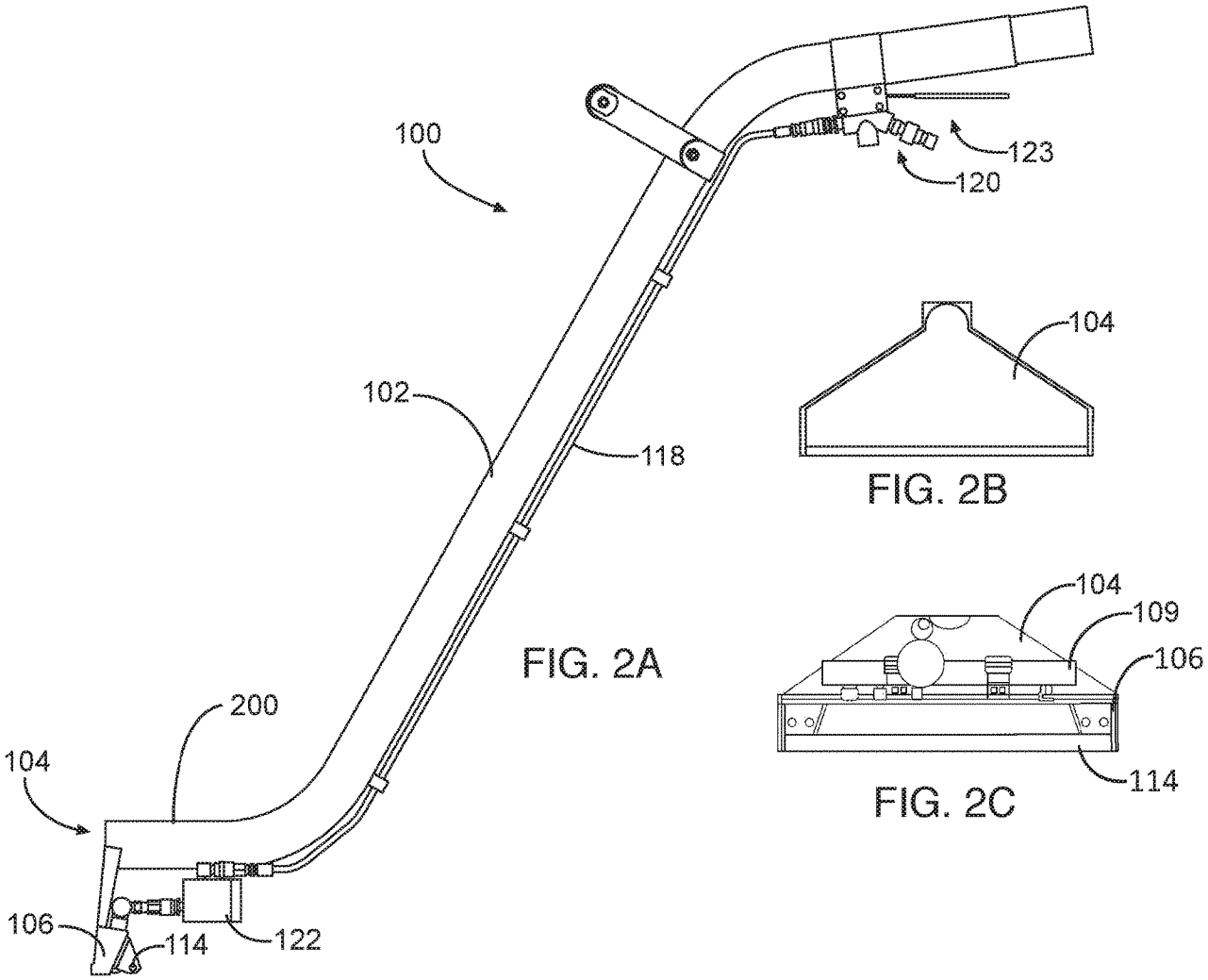
FIG. 2A illustrates a side elevation view of a representative embodiment of the wand.
FIG. 2B illustrates a front elevation view of a representative embodiment of a wand head.
FIG. 2C illustrates a back elevation view of a representative embodiment of the wand head.
Figures 3A, 3B, 3C:
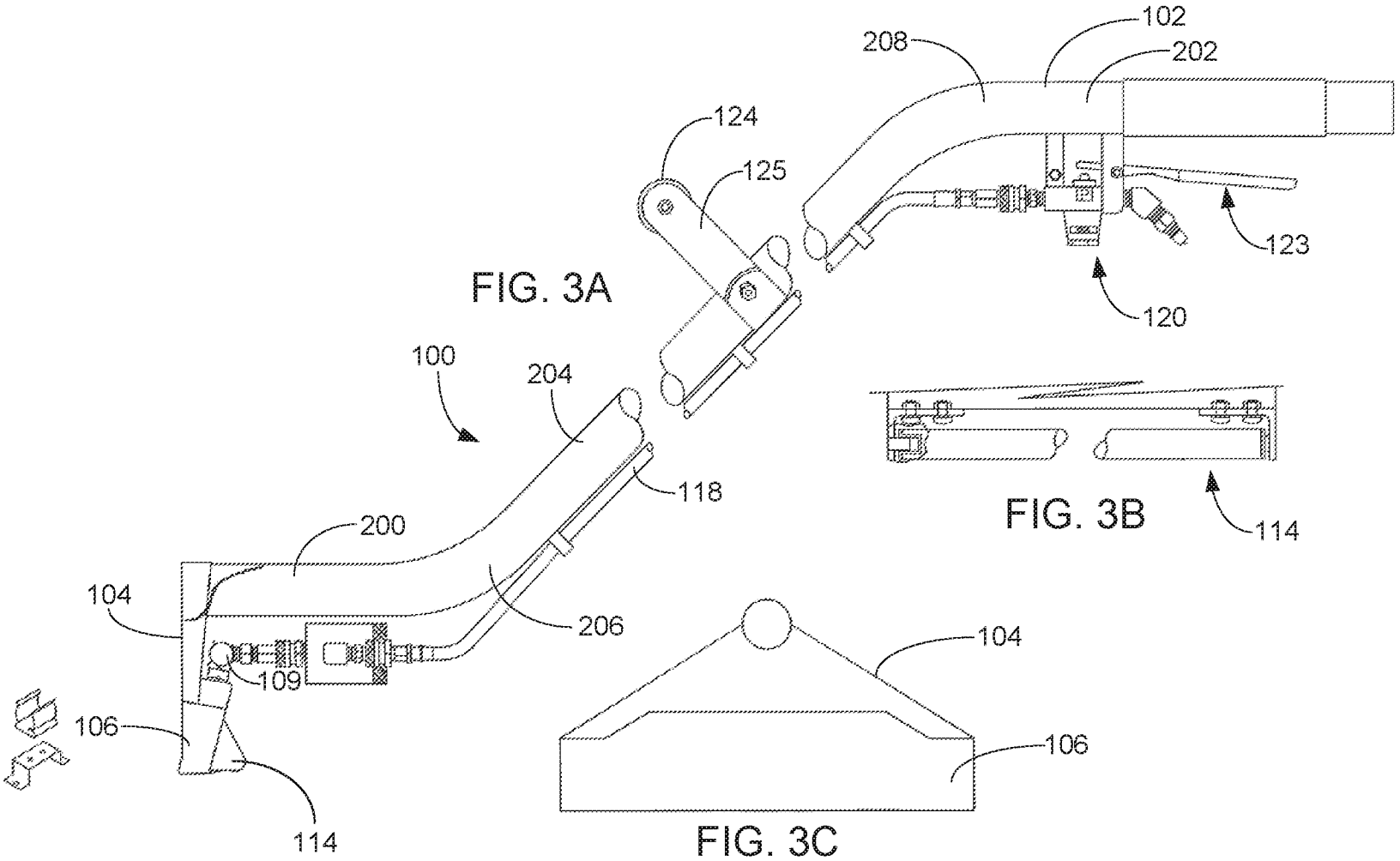
FIG. 3A illustrates a side schematic view of a representative embodiment of the wand.
FIG. 3B illustrates a plan view of a representative embodiment of a roller.
FIG. 3C illustrates a back elevation view of a representative embodiment of the wand head.
Figure 4:
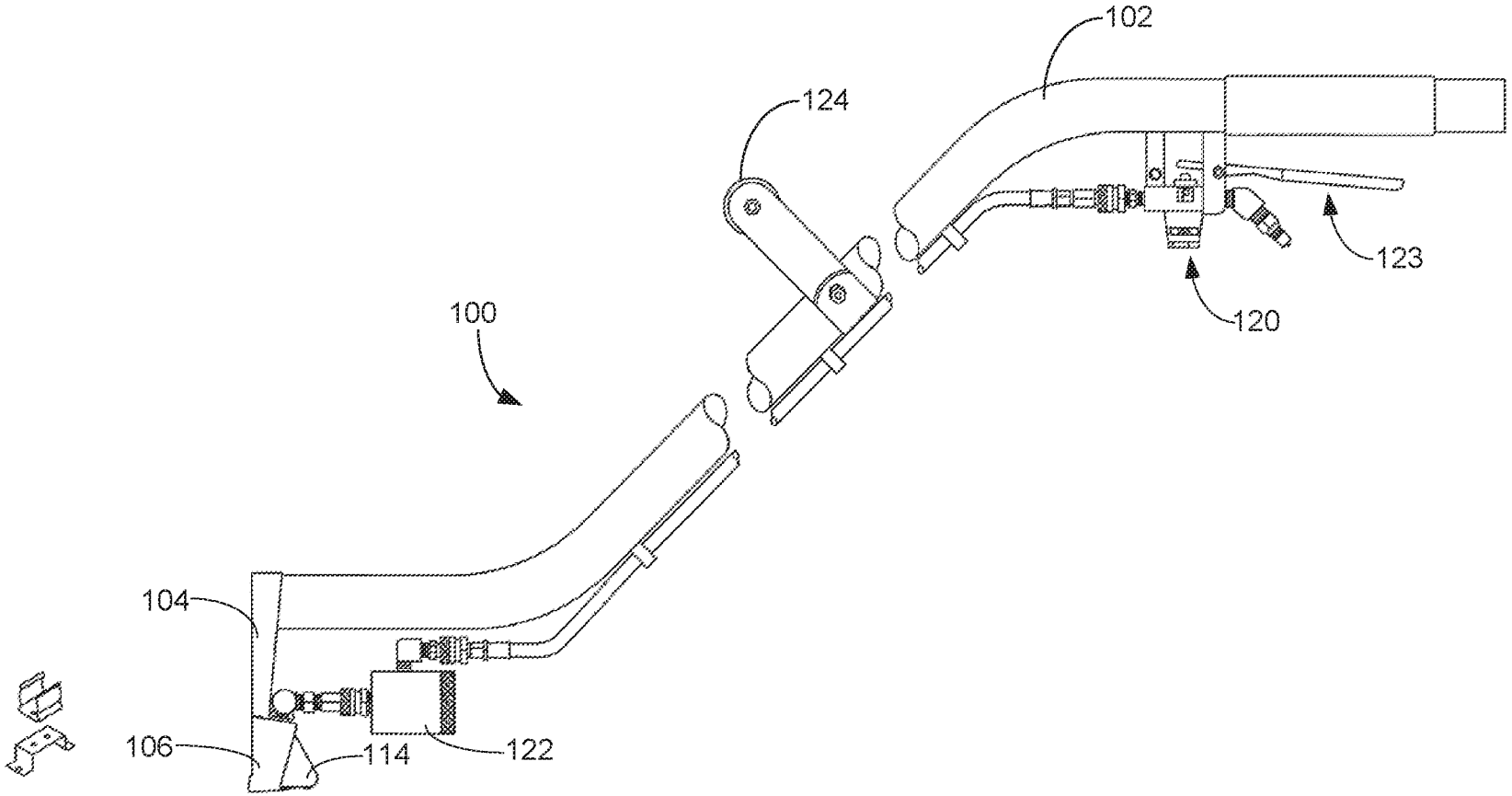
FIG. 4 illustrates a side schematic view of a representative embodiment of the wand.

With reference now to the handle 124, the wand 100 can comprise any suitable gripping surface and/or handle that allow a user to grab and maneuver the wand as desired. By way of non-limiting illustration, FIG. 1B shows an embodiment in which the wand 100 comprises a gripping surface 222 disposed on the second section 202 and a handle 124 that is coupled to the third section 204 of the vacuum tube 102.

Where the handle 124 is coupled to the third section 204 of the vacuum tube 102, the handle can be coupled to the tube in any suitable manner and in any suitable orientation. Indeed, FIG. 1B shows that, in some embodiments, the handle 124 is coupled to the tube 102 via a handle support 125 that extends substantially perpendicularly from the tube. In accordance with some other embodiments, however, FIG. 1D shows the handle support 125 extends from the tube 102 at an acute angle, towards the back end 212 of the vacuum tube 102. Additionally, FIGS. 1H and 1I show that, in some embodiments, the handle support 125 is shaped so that the handle 124 is disposed along a length of the tube closer to the tube's back end 212 (not shown in FIGS. 1H and 1I) than is the point at which the handle support is coupled to the tube 102. In still other embodiments (not shown) the handle support is angled towards the front end of the vacuum tube (e.g., at an acute angle) and/or is shaped such that the handle is disposed closer to the wand head 104 (along a length of the tube) than is the point at which the handle support couples to the tube.

In addition to the aforementioned components, the described wand 100 can comprise any other suitable component or characteristic that allows it to function as described herein. Some examples of such components include, but are not limited to, one or more jet manifolds 109 that are configured to direct fluid from the feed lines to the jets 108, clips 131 and/or other mechanisms that are configured to selectively and/or permanently couple the jet manifold to the wand head 104, caps, manifold covers, fittings, connectors, valve connectors, disconnects (e.g., quick disconnects or otherwise), check valves, filter housings, bushings (e.g., for the roller 114), bearings, jet housings, pressure valves (e.g., to allow air into the shroud when pressure drops below a set level and/or for any other suitable purpose), shells, lights, pressure gauges (e.g., to determine vacuum pressure in the vacuum tube 102 or for any other suitable purpose), agitators, and/or other suitable components.

As another example of a suitable component, some embodiments of the described wand 100 (and/or a system comprising the wand) include one or more sensors that determine how much fluid has been applied to (and/or remains at) a flooring surface. Indeed, in some embodiments, the wand comprises one or more moisture sensors that determine the moisture level of the flooring over which the wand passes. In some such embodiments, the wand and/or a system comprising the wand is configured to provide an indication of the moisture level of the flooring (e.g., via one or more lights, sounds, displays, and/or other signals) and/or to automatically increase, decrease, start, stop, and/or otherwise control the amount of fluid that is sprayed from the wand head based on such moisture level.

In some other embodiments, the wand 100 (and/or a system comprising the wand) is configured to determine how much fluid the wand lets out and how much fluid the wand sucks up (e.g., to determine how much fluid is left in the flooring and/or for any other suitable purpose). In such embodiments, the wand and/or its system can make such determinations in any suitable manner. Indeed, in some embodiments, the wand comprises one or more sensors that determine how much fluid is dispensed through the head (e.g., one or more flow meters, fluid level sensors, electric eyes, mass sensors, scales, moisture sensors, fluid sensors, and/or any other suitable sensors that are capable of determining how much fluid is dispensed from the jets) and one or more sensors that determine how much fluid has been sucked up through the vacuum tube 102 (e.g., one or more flow meters, fluid level sensors, electric eyes, mass sensors, scales, moisture sensors, fluid sensors, and/or any other suitable sensors that are capable of determining how much fluid has been sucked up through the vacuum tube).

Figure 8:
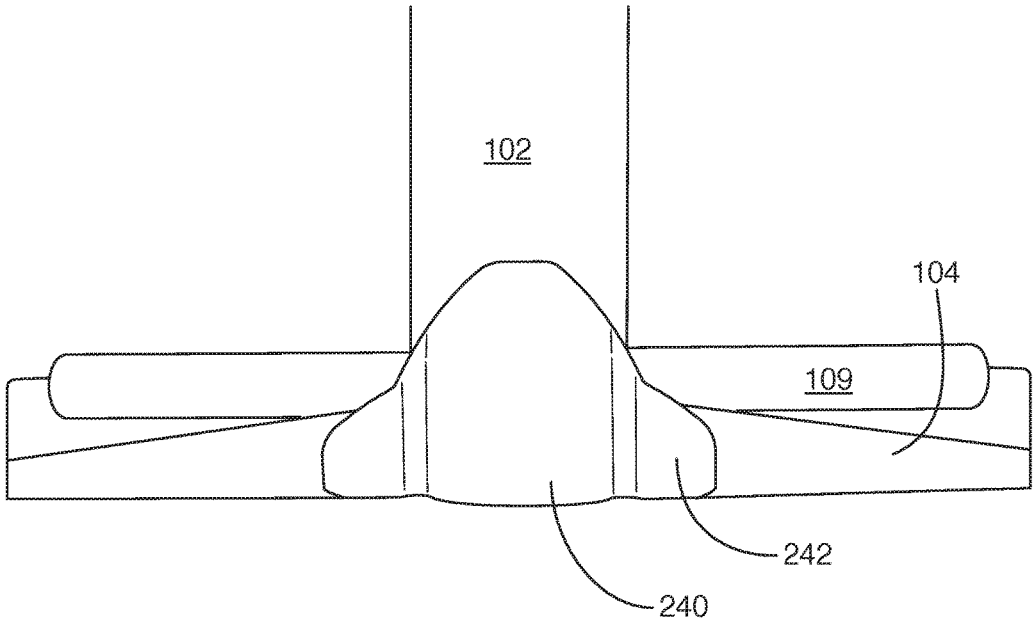

As still another example, some embodiments of the wand 100 are configured to provide additional strength to the connection between the vacuum tube 102 and the wand head 104. While this can be accomplished in any suitable manner, FIG. 8 shows that, in some embodiments, a collar 240 with one or more gussets 242 and/or other supports is welded, adhered, riveted, and/or otherwise coupled between the wand head 104 and the vacuum tube 102.

As another example, some embodiments of the wand head 104 and/or the shroud comprise a lower section is adjustably coupled to the wand head (e.g., via one or more mechanical fasteners, mechanical mechanisms, frictional engagements, detents, clamps, and/or other suitable mechanisms) such that an angle of such lower section can be adjusted with respect to an upper portion of the head and/or the vacuum tube. In some such embodiments, the head can be adjusted such that the back end 212 of the vacuum tube can be raised or lowered while the head is able to keep a seal (or at least a partial seal) with the flooring being cleaned.

Figure 6:
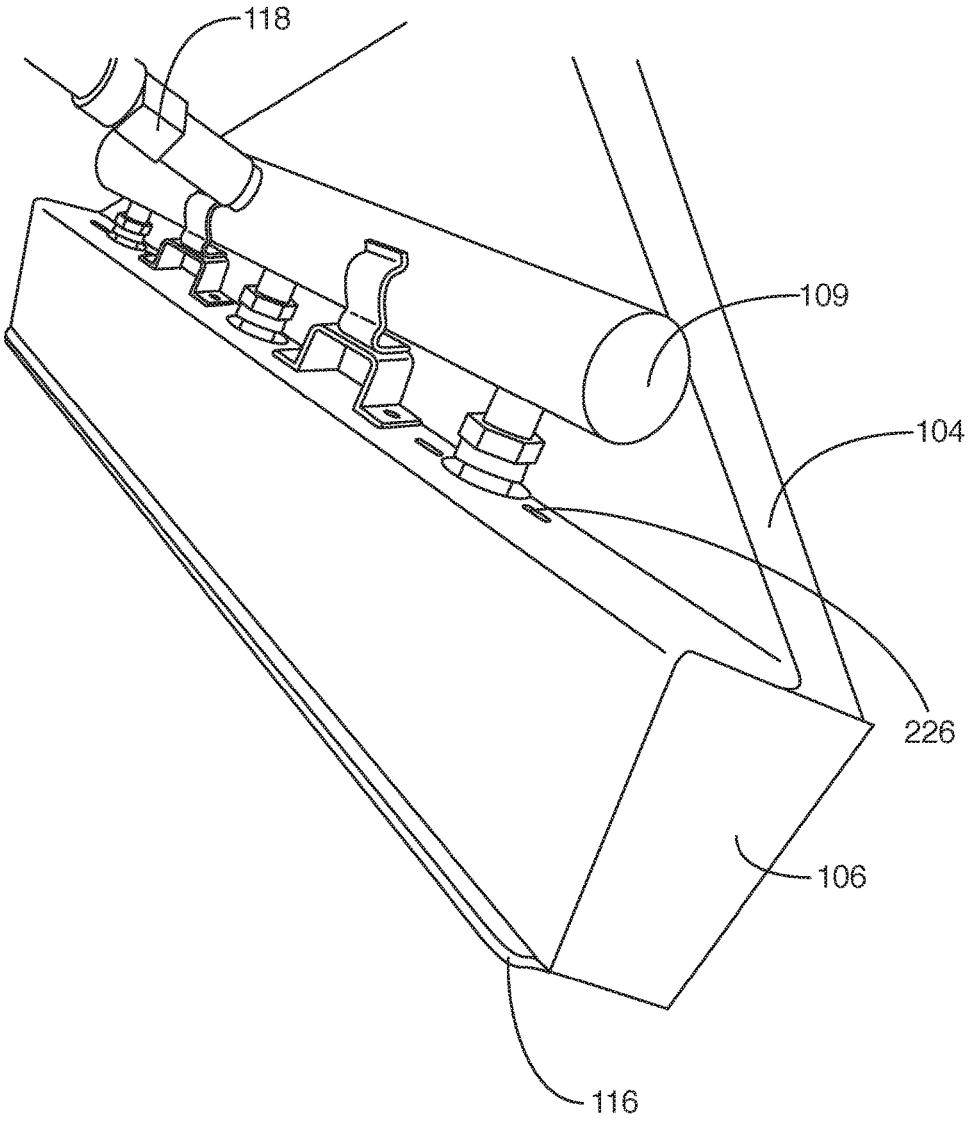
FIGS. 6-9 each depict a perspective view of a portion of the wand head in accordance with some representative embodiments.
Figure 7:
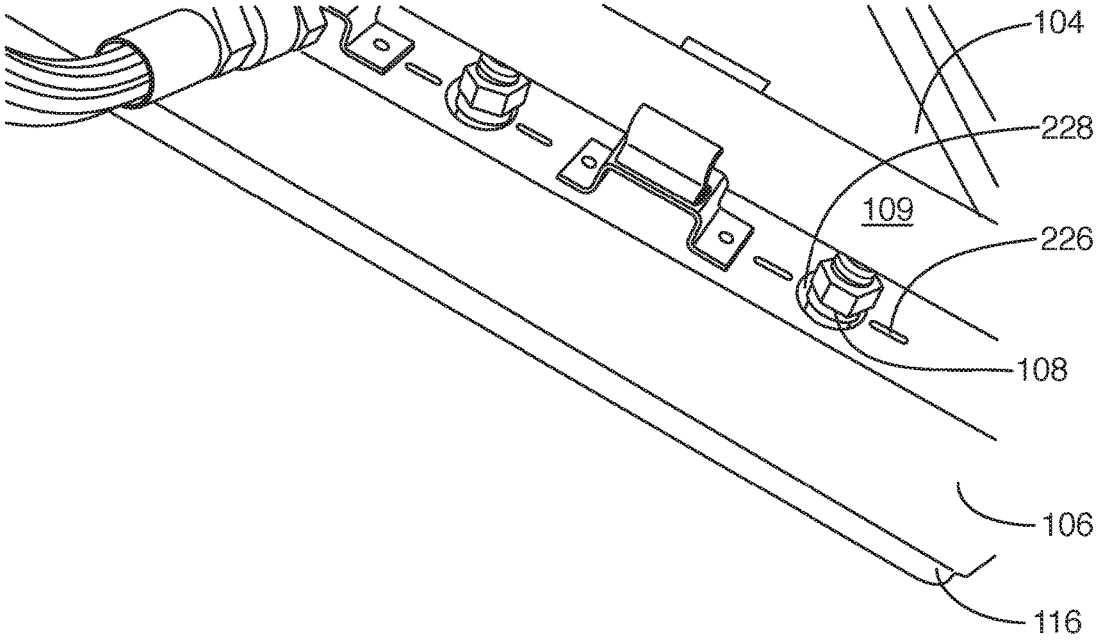

As an additional example of another suitable component, some embodiments of the described wand head 104 and/or the shroud 106 comprise one or more air inlets that allow air to enter into the head when the head is forming (or substantially forming) a seal with a flooring surface. Accordingly, in some such embodiments, the head is able to form a seal with the flooring while still having enough air flow to suck fluid and/or debris up into the vacuum tube 102. In this regard, while such vents can be disposed in any suitable location, FIGS. 6-7 show that, in some embodiments, the shroud 106 defines one or more apertures 226 and/or openings 228 around the jets 108 that are configured to allow a desired amount of air to flow into the shroud 106 while allowing the shroud to form a seal (or partial seal) with a flooring surface (not shown).

As an additional example of a suitable characteristic, in addition to, or in place of, the lip 116, any other suitable portion of the wand head 104 and/or the shroud 106 (e.g., a portion that is configured to contact a flooring surface when the head is in use and/or any other suitable portion of the wand head, such as the breaker bar 112) may be rounded. While such rounding can perform any suitable function, in some embodiments, such rounding helps reduce friction between the wand head and a flooring surface.

In addition to the aforementioned characteristics, the described wand 100 can have any other suitable characteristic that allows it to operate as intended. Indeed, in some embodiments, the vacuum tube 102 is (as described here) ergonomically shaped to be more comfortable and easy to use than some conventional cleaning attachments.

Additionally, in some embodiments, the described head is configured to deliver a high-pressure controlled spray that loosens dirt and allows the dirt to be removed through a relatively powerful extraction wand. Moreover, in some embodiments, the described wand is configured to prevent flooring surfaces from being flooded with excess fluid. As a result, some embodiments of the described wand are configured to leave flooring surfaces cleaner (e.g., by removing more water, soap, detergent, debris, etc.) than some conventional cleaning devices. Furthermore, as some embodiments of the described wand leave less fluid in flooring than do some conventional devices; such embodiments are able to allow flooring to dry faster than do some conventional devices.

The various portions of the described wand 100 can be made in any suitable manner. In this regard, some non-limiting examples of methods for making the described wand (e.g., the vacuum tube 102, the wand head 104, and/or other components of the wand) include extruding; molding; machining; bending; straightening; cutting; grinding; filing; smoothing; buffing; polishing; connecting various pieces with one or more mechanical fasteners (e.g., nails, clamps, rivets, staples, clips, pegs, crimps, pins, brads, threads, brackets, quick-connect couplers, nuts, bolts, threaded engagements, screws, etc.), welds, by melting pieces together, adhesives, etc.); and/or any other suitable method that allows the described wand to be formed and perform its intended functions.

Thus, as discussed herein, the embodiments of the present invention relates to systems and methods for cleaning flooring. In particular, the present invention relates to systems and methods for providing a wand that is configured to clean flooring, such as carpets, rugs, tiles, stone, wood, and/or any other flooring surface.

The present invention may be embodied in other specific forms without departing from its spirit or essential characteristics. The described embodiments, examples, and illustrations are to be considered in all respects only as illustrative and not restrictive. The scope of the invention is, therefore, indicated by the appended claims rather than by the foregoing description. All changes that come within the meaning and range of equivalency of the claims are to be embraced within their scope. In addition, as the terms on, disposed on, attached to, connected to, coupled to, etc. are used herein, one object (e.g., a material, element, structure, member, etc.) can be on, disposed on, attached to, connected to, or coupled to another object—regardless of whether the one object is directly on, attached, connected, or coupled to the other object, or whether there are one or more intervening objects between the one object and the other object. Also, directions (e.g., front, back, on top of, below, above, top, bottom, side, up, down, under, over, upper, lower, etc.), if provided, are relative and provided solely by way of example and for ease of illustration and discussion and not by way of limitation. Where reference is made to a list of elements (e.g., elements a, b, c), such reference is intended to include any one of the listed elements by itself, any combination of less than all of the listed elements, and/or a combination of all of the listed elements. Furthermore, as used herein, the terms a, an, and one may each be interchangeable with the terms at least one and one or more.

What is claimed is:

1. A wand comprising:

a wand head comprising:

a shroud that defines a vacuum port and a first chamber, wherein the shroud is coupled to a vacuum tube such that the vacuum tube extends back from an upper portion of the shroud;

a jet that is coupled to the shroud so as to be configured to spray effluent from the jet, through the first chamber, and to a surface to be cleaned;

a divider that is disposed in the shroud to separate a portion of the vacuum port from a portion of the first chamber;

one or more lips that extend from a lowest portion of a back side of the shroud, adjacent to the first chamber, wherein the one or more lips substantially extend across a width of the shroud, and wherein, in operation, the one or more lips extend away from the surface to be cleaned and towards a portion of the vacuum tube as the one or more lips extend away from the backside of the shroud; and one or more rollers that are disposed behind the one or more lips, wherein the one or more rollers substantially extend across the width of the shroud.

2. The wand of claim 1, further comprising a first air inlet and a second air inlet that are defined in the shroud, wherein the jet is disposed on the shroud between the first air inlet and the second air inlet such that the first and second air inlets are configured to allow air to flow through the first and second air inlets, into the first chamber, around the divider, and then into the vacuum port.

3. The wand of claim 1, wherein the one or more rollers comprise a single roller that is coupled to the shroud, wherein the single roller substantially extends across the width of the wand head.

4. The wand of claim 3, wherein the one or more rollers are configured to be selectively raised and lowered with respect to the wand head.

5. The wand of claim 1, wherein the divider comprises a breaker bar, and wherein a lowest edge of the breaker bar is configured to be selectively raised and lowered within the shroud.

6. The wand of claim 1, wherein the one or more lips comprise a single lip that extends substantially across the width of the wand head.

7. The wand of claim 1, wherein the vacuum port is in fluid communication with the vacuum tube, wherein the vacuum tube comprises a first section that couples to the shroud, a second section that is configured to couple with a vacuum hose, and a third, elongated section that is disposed between the first section and the second section, wherein the vacuum tube further comprises a handle that is coupled via a handle support to the third, elongated section, and wherein the handle support extends from the third, elongated section at an acute angle toward the second section of the vacuum tube.

8. The wand of claim 1, further comprising a feed line that couples to the jet, and a filter that is coupled to the feed line, adjacent to a wand trigger assembly of the vacuum tube.

9. The wand of claim 1, wherein the vacuum tube comprises an inner diameter between about 4.25 cm and about 4.7 cm.

10. The wand of claim 1, wherein the vacuum port is in fluid communication with the vacuum tube, wherein the vacuum tube comprises a first section that couples to the shroud, a second section that is configured to couple with a vacuum hose, and a third, elongated section that is disposed between the first section and the second section, wherein a front surface of the shroud is swept forward such that the front surface of the shroud runs at an angle that is less than 90 degrees with respect to a longitudinal axis of the first section of the vacuum tube.

11. A wand comprising:

a wand head comprising:

a shroud that defines a vacuum port and a first chamber, the shroud being coupled to a vacuum tube such that the vacuum tube extends back from an upper portion of the shroud;

one or more lips that extend from a lowest portion of a back side of the shroud, adjacent to the first chamber. wherein the one or more lips substantially extend across a width of the shroud, and wherein, in operation, the one or more lips extend away from a surface to be cleaned and towards a portion of the vacuum tube as the one or more lips extend away from the back side of the shroud; and one or more rollers that are disposed behind the one or more lips, wherein the one or more rollers substantially extend across the width of the shroud; and a recessed breaker bar that is recessed within the shroud so as to be disposed between a portion of the vacuum port and a portion of the first chamber.

12. The wand of claim 11, wherein the vacuum tube comprises a first section that couples to the shroud, a second section that is configured to couple with a vacuum hose, and a third, elongated section that is disposed between the first section and the second section, and wherein a longitudinal axis of the third, elongated section runs at an angle between about 41 degrees and about 44 degrees with respect to a longitudinal axis of the second section, and wherein the longitudinal axis of the third, elongated section runs at an angle between about 40 degrees and about 44 degrees with respect to a longitudinal axis of the first section.

13. The wand of claim 11, wherein the recessed breaker bar is adjustably coupled to the wand head so as to be selectively raised and lowered in the wand head.

14. The wand of claim 11, further comprising a feed line that couples to a jet that is coupled to the shroud, and a filter that is coupled to the feed line and that is disposed along a length of the vacuum tube, the vacuum tube having a first section that couples to the shroud, a second section that is configured to couple with a vacuum hose, and a third, elongated section that is disposed between the first section and the second section, wherein the filter is disposed between a midpoint of a length of the third, elongated section and an end of the second section that is configured to couple to the vacuum hose.

15. The wand of claim 11, wherein the one or more rollers are configured to be selectively raised and lowered with respect to the wand head.

16. A wand comprising:

a wand head comprising:

a jet;

a shroud that defines a vacuum port and a first chamber, the jet being coupled to the shroud so as to be configured to spray a fluid through the first chamber to a surface to be cleaned, wherein the shroud is coupled to a vacuum tube such that the vacuum tube extends back from an upper portion of the shroud;

a recessed breaker bar that is recessed within the shroud so as to be disposed between the vacuum port and the first chamber;

a lip that that extends from a lowest portion of a back side of the shroud, adjacent to the first chamber, wherein the lip substantially extends across a width of the shroud, and wherein, when the shroud substantially forms a seal with the surface to the cleaned, as the lip extends away from the back side of the shroud, the lip extends away from the surface to be cleaned and towards a portion of the vacuum tube; and one or more rollers that are disposed behind the one or more lips, wherein the one or more rollers substantially extend across the width of the shroud.

17. The wand of claim 16, wherein the vacuum tube comprises a first section that couples to the shroud, a second section that is configured to couple with a vacuum hose, and a third, elongated section that is disposed between the first section and the second section, wherein the wand further comprises a feed line that couples to the jet, and a filter that is coupled to the feed line and that is disposed along a length of the vacuum tube that is disposed between a midpoint of a length of the third, elongated section and an end of the second section that is configured to couple to the vacuum hose.

18. The wand of claim 16, wherein the one or more rollers comprise a single roller that is coupled to the shroud, and wherein the single roller substantially extends across the width of the wand head.

19. A wand comprising:

a jet;

a shroud that is coupled to a vacuum tube such that the vacuum tube extends back from an upper portion of the shroud, the shroud defining a vacuum port and a first chamber, the jet being coupled to the shroud and the first chamber so as to be configured to spray a fluid through the first chamber to a surface to be cleaned;

a recessed breaker bar that is recessed within the shroud so as to be disposed between a portion of the vacuum port and a portion of the first chamber;

a feed line that couples to the jet, with a filter coupled to the feed line;

one or more lips that extend from a lowest portion of a back side of the shroud, adjacent to the first chamber, wherein the one or more lips substantially extend across a width of the shroud, and wherein, in operation, the one or more lips extend away from the surface to be cleaned and towards a portion of the vacuum tube as the one or more lips extend backwards, away from the back side of the shroud; and one or more rollers that are disposed behind the one or more lips, wherein the one or more rollers substantially extend across the width of the shroud, wherein the vacuum tube comprises a first section that couples to the shroud, a second section that is configured to couple with a vacuum hose, and a third, elongated section that is disposed between the first section and the second section, and wherein the filter is disposed between a midpoint of a length of the third, elongated section and an end of the second section that is configured to couple to the vacuum hose.

20. A wand comprising:

a jet;

a shroud that is coupled to a vacuum tube and that defines a vacuum port and a first chamber, the jet being coupled to the shroud and first chamber so as to be configured to spray a fluid through the first chamber to a surface to be cleaned a recessed breaker bar that is recessed within the shroud so as to be disposed between a portion of the vacuum port and a portion of the first chamber;

a feed line that couples to the jet, with a filter coupled to the feed line; and a lip that extends from a lowest portion of a rear d of the shroud, adjacent to the first chamber, wherein a contact surface of the lip extends upwards towards the vacuum tube as the lip extends away from the lowest portion of the rear end of the shroud, wherein the shroud defines a first and a second air inlet that are each disposed on an opposite side of the jet and that are configured to allow air to flow through first and second air inlets into the first compartment when the shroud is substantially forming a seal with the surface to be cleaned, wherein the vacuum tube comprises a first section that couples to the shroud a second section at is configured to couple with a vacuum hose, and a third, elongated section that is disposed between the first section the second section, and wherein the filter is disposed between a midpoint of a length of the third, elongated section and an end of the second section that is configured to couple to the vacuum hose.

21. The wand of claim 20, wherein a longitudinal axis of the third, elongated section of the vacuum tube runs at an angle between about 41 degrees and about 44 degrees with respect to a longitudinal axis of the second section, and wherein the longitudinal axis of the third, elongated section runs at an angle between about 40 degrees and about 44 degrees with respect to a longitudinal axis of the first section, and wherein a front surface of the shroud is swept forward such that the front surface of the shroud runs at an angle that is less than 90 degrees with respect to the longitudinal axis of the first section of the vacuum tube.

* * * * *